US010857046B2

(12) United States Patent
Kim et al.

(10) Patent No.: US 10,857,046 B2
(45) Date of Patent: Dec. 8, 2020

(54) WHEELCHAIR POWER APPARATUS FOR ELECTRONIC DRIVING CONVERSION

(71) Applicants: Joon-Hyung Kim, Seoul (KR); Seong Hyun Paek, Gwangju-si (KR)

(72) Inventors: Joon-Hyung Kim, Seoul (KR); Seong Hyun Paek, Gwangju-si (KR)

(73) Assignee: ROBO3 CO., LTD., Seoul (KR)

( * ) Notice: Subject to any disclaimer, the term of this patent is extended or adjusted under 35 U.S.C. 154(b) by 203 days.

(21) Appl. No.: 16/149,037

(22) Filed: Oct. 1, 2018

(65) Prior Publication Data

US 2020/0000657 A1 Jan. 2, 2020

(30) Foreign Application Priority Data

Jun. 28, 2018 (KR) ..... 10-2018-0074538

(51) Int. Cl.
*A61G 5/04* (2013.01)

(52) U.S. Cl.
CPC ..... *A61G 5/047* (2013.01); *A61G 5/042* (2013.01)

(58) Field of Classification Search
CPC ..... A61G 5/047; A61G 5/042
See application file for complete search history.

(56) References Cited

U.S. PATENT DOCUMENTS 4,386,672 A * 6/1983 Coker ..... A61G 5/047 180/13
4,503,925 A * 3/1985 Palmer ..... A61G 5/047 180/13
5,016,720 A * 5/1991 Coker ..... A61G 5/047 180/13
5,050,695 A * 9/1991 Kleinwolterink, Jr. ..... A61G 5/047 180/13
5,494,126 A * 2/1996 Meeker ..... A61G 5/047 180/13
5,651,422 A * 7/1997 Casali ..... A61G 5/047 180/13
5,826,670 A * 10/1998 Nan ..... A61G 5/047 180/15
6,883,632 B2 * 4/2005 McHardy ..... A61G 5/047 180/13

(Continued)

*Primary Examiner* — Kevin Hurley
*Assistant Examiner* — Michael R Stabley
(74) *Attorney, Agent, or Firm* — John K. Park; Park Law Firm

(57) ABSTRACT

Disclosed is a wheelchair power apparatus for electronic driving conversion. The wheelchair power apparatus for electronic driving conversion includes: an electronic module combined with a combining means of a manual wheelchair, wherein the electronic module includes: a driving wheel in which an in-wheel motor is mounted; an operation handle located directly above the driving wheel; a connector connected directly below the operation handle; a steering housing mounted directly below the connector in such a way that one side of the connector can be moved forwards or backwards inside the steering housing; a combining unit mounted directly below the steering housing and combined with a coupling means of a wheelchair; a battery mounted at the front of the combining unit; and strut supports and collapsible bars mounted at right and left sides of the driving wheel, so that the manual wheelchair is converted into an electronic wheelchair.

1 Claim, 14 Drawing Sheets

(56) References Cited

U.S. PATENT DOCUMENTS

| | | | | |
|---|---|---|---|---|
| 7,174,093 | B2 * | 2/2007 | Kidd | A61G 5/047 180/58 |
| 7,216,728 | B2 * | 5/2007 | Huang | A61G 5/047 180/13 |
| 7,306,250 | B1 * | 12/2007 | Mills | A61G 5/047 180/11 |
| 7,694,991 | B2 * | 4/2010 | Mills | A61G 5/1051 180/11 |
| 7,976,049 | B2 * | 7/2011 | Chiu | A61G 5/047 180/13 |
| 8,684,113 | B1 * | 4/2014 | Laconis | A61G 5/047 180/11 |
| 9,326,901 | B2 * | 5/2016 | Conte | A61G 5/047 |
| 9,872,805 | B2 * | 1/2018 | Bach Castillo | B62K 5/025 |
| 10,076,457 | B2 * | 9/2018 | Behm | A61G 5/025 |
| 10,299,973 | B2 * | 5/2019 | Conte | A61G 5/04 |
| 2004/0108147 | A1 * | 6/2004 | Ross | A61G 5/047 180/13 |
| 2005/0206115 | A1 * | 9/2005 | Lee | A61G 5/047 280/250.1 |
| 2006/0000664 | A1 * | 1/2006 | Huang | A61G 5/047 180/198 |
| 2007/0096427 | A1 * | 5/2007 | Knaub | A61G 5/1051 280/304.1 |
| 2008/0115982 | A1 * | 5/2008 | Lin | A61G 5/1051 180/13 |
| 2011/0095508 | A1 * | 4/2011 | Chiu | A61G 5/047 280/304.1 |
| 2015/0351979 | A1 * | 12/2015 | Conte | B62B 3/0612 180/13 |
| 2016/0317368 | A1 * | 11/2016 | Bach Castillo | A61G 5/027 |
| 2018/0028378 | A1 * | 2/2018 | Behm | A61G 5/042 |
| 2018/0140486 | A1 * | 5/2018 | Klein | A61G 5/122 |
| 2018/0147100 | A1 * | 5/2018 | Conte | A61G 5/10 |
| 2018/0338877 | A1 * | 11/2018 | Kano | A61G 5/047 |
| 2019/0015272 | A1 * | 1/2019 | Benedini | A61G 5/047 |

* cited by examiner

【Figure 1】
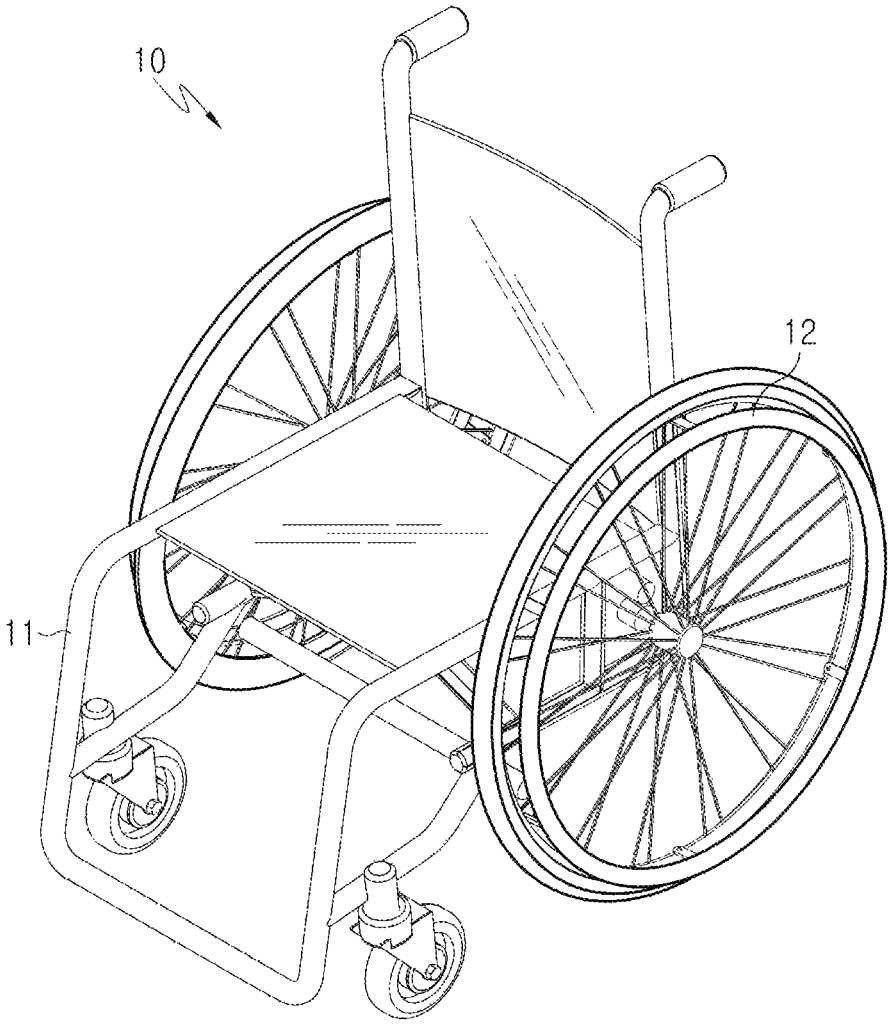

【Figure 2】
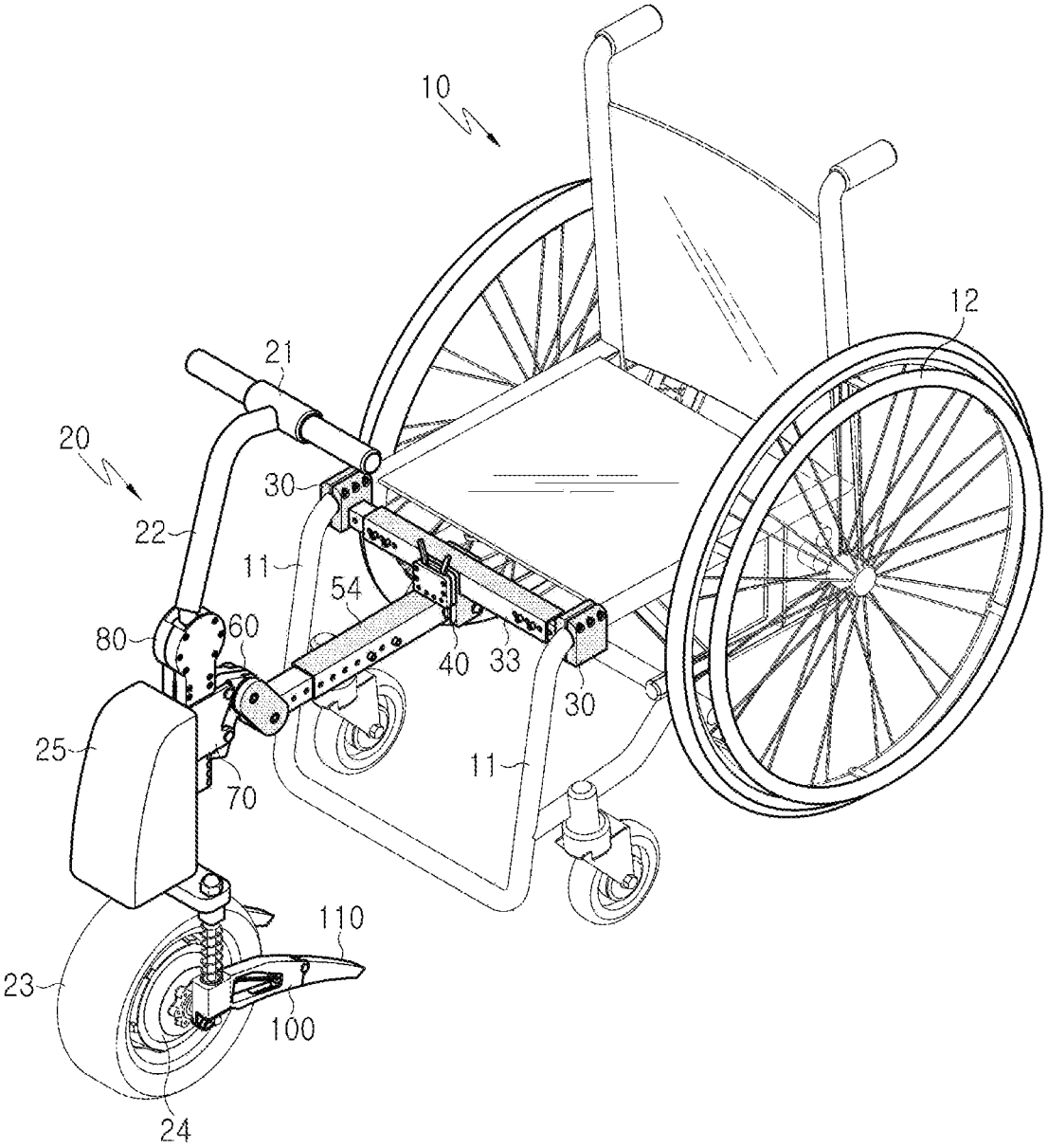

【Figure 3】
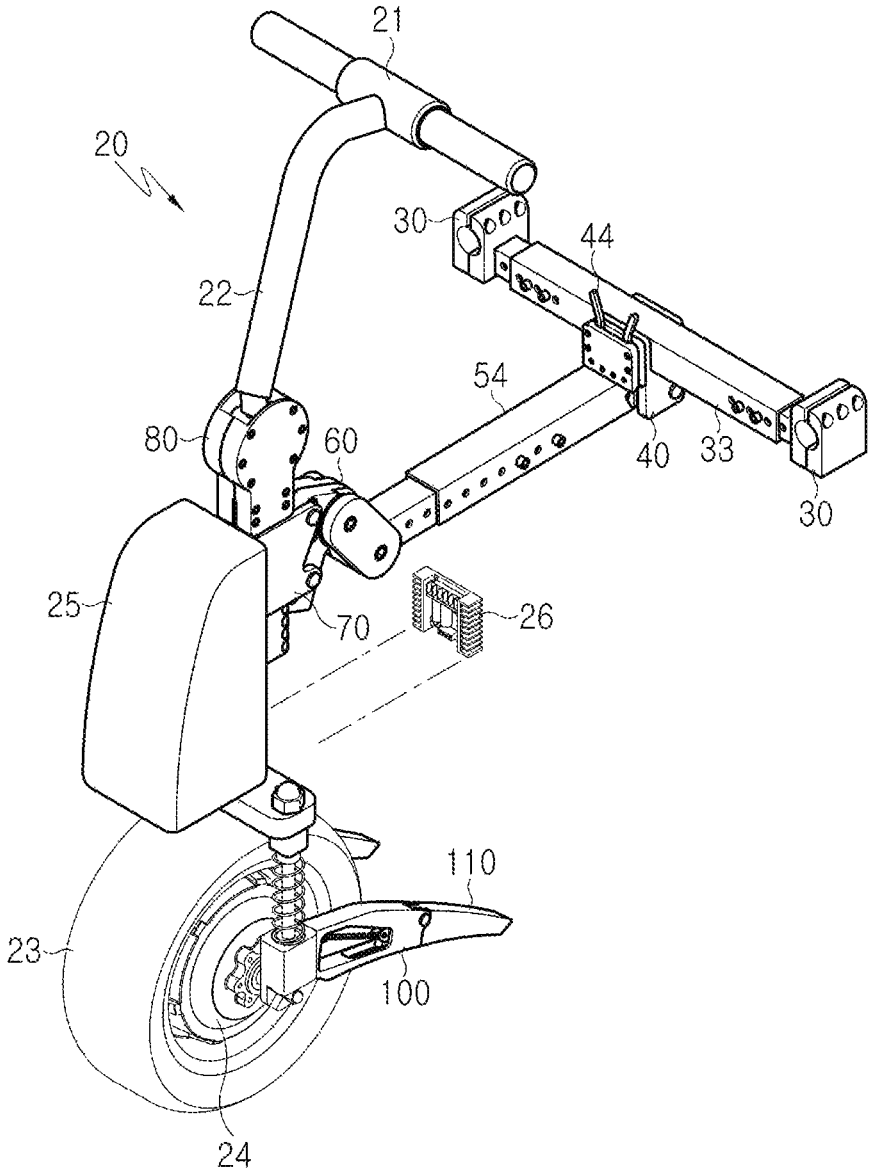

【Figure 4】
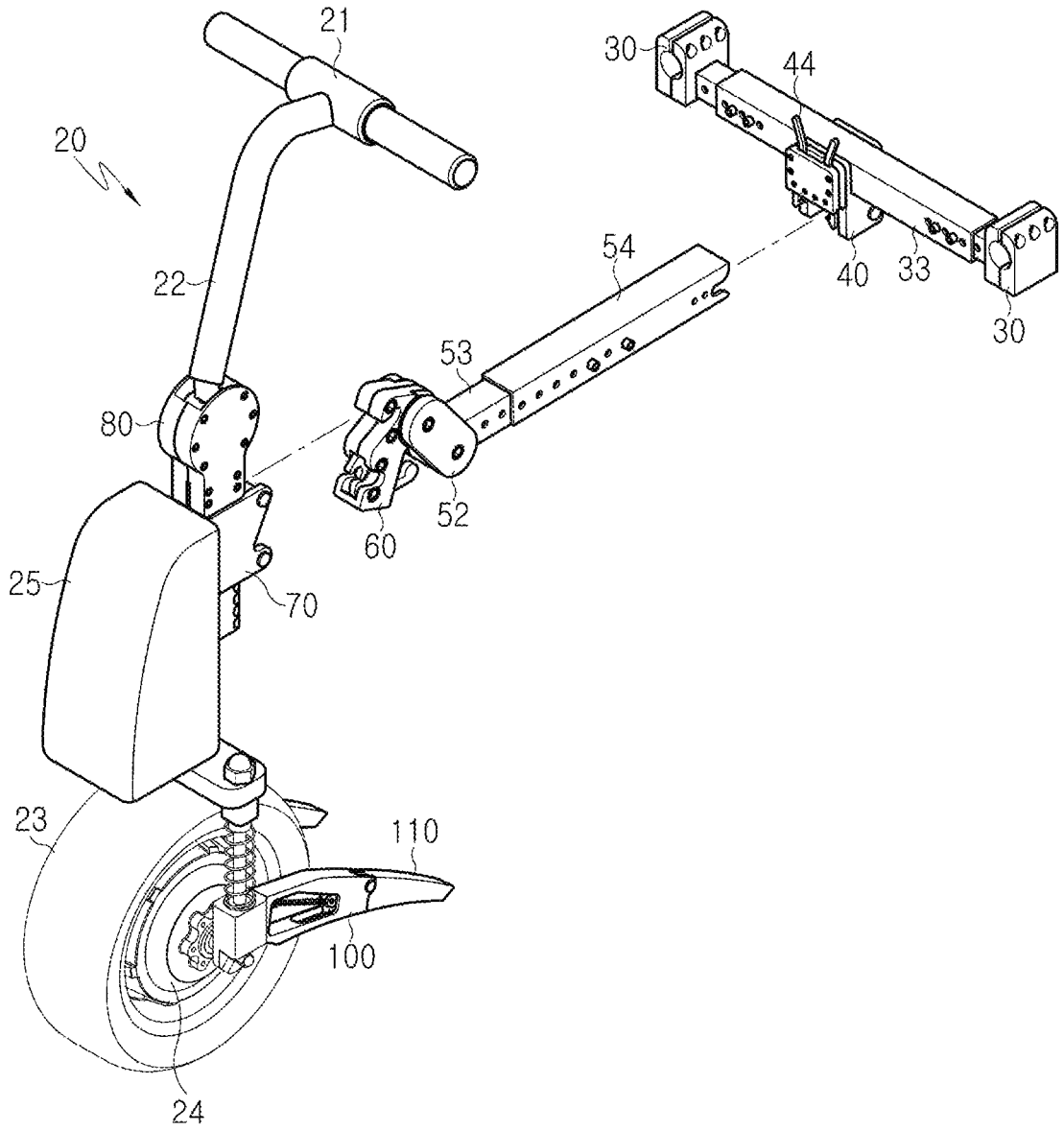

【Figure 5】
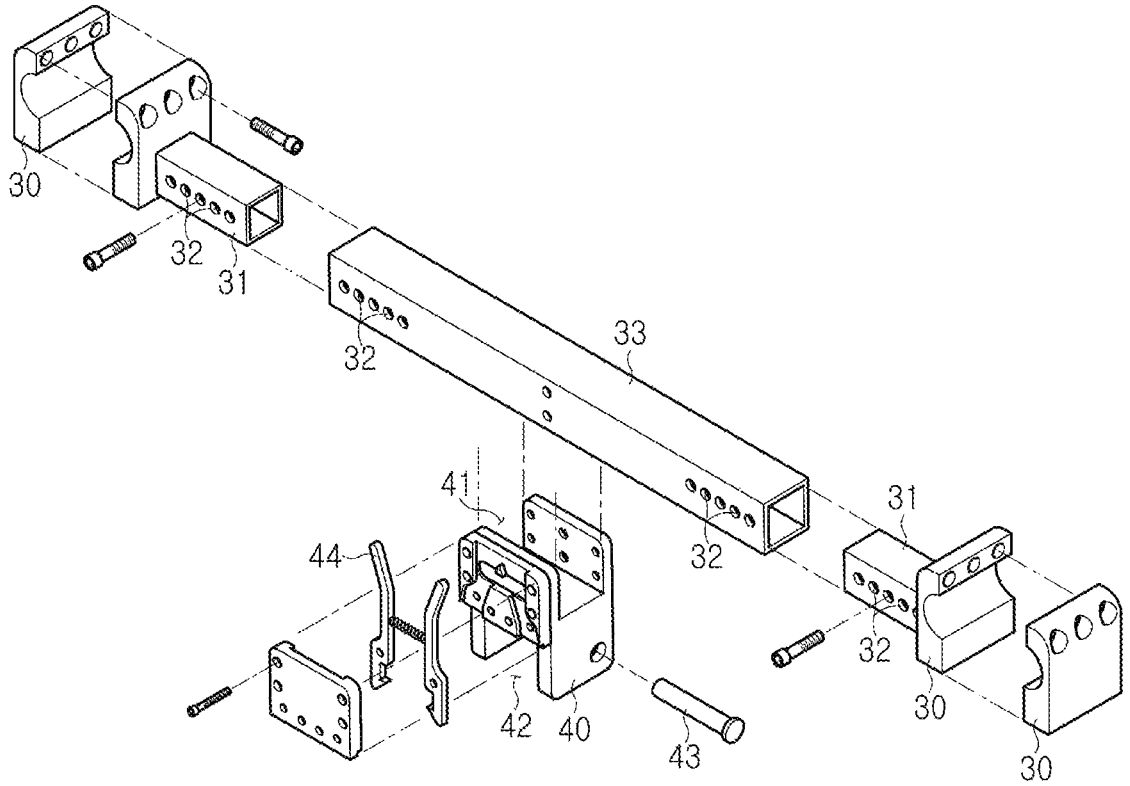
(a)
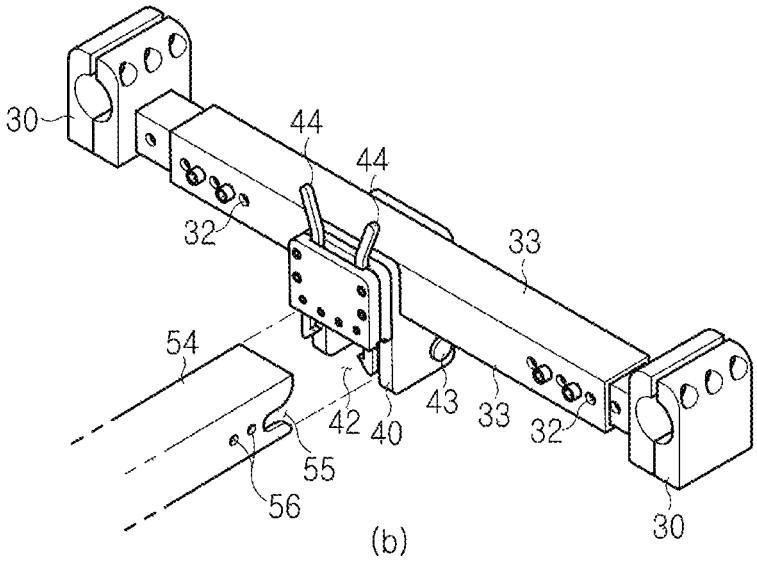
(b)

【Figure 6】
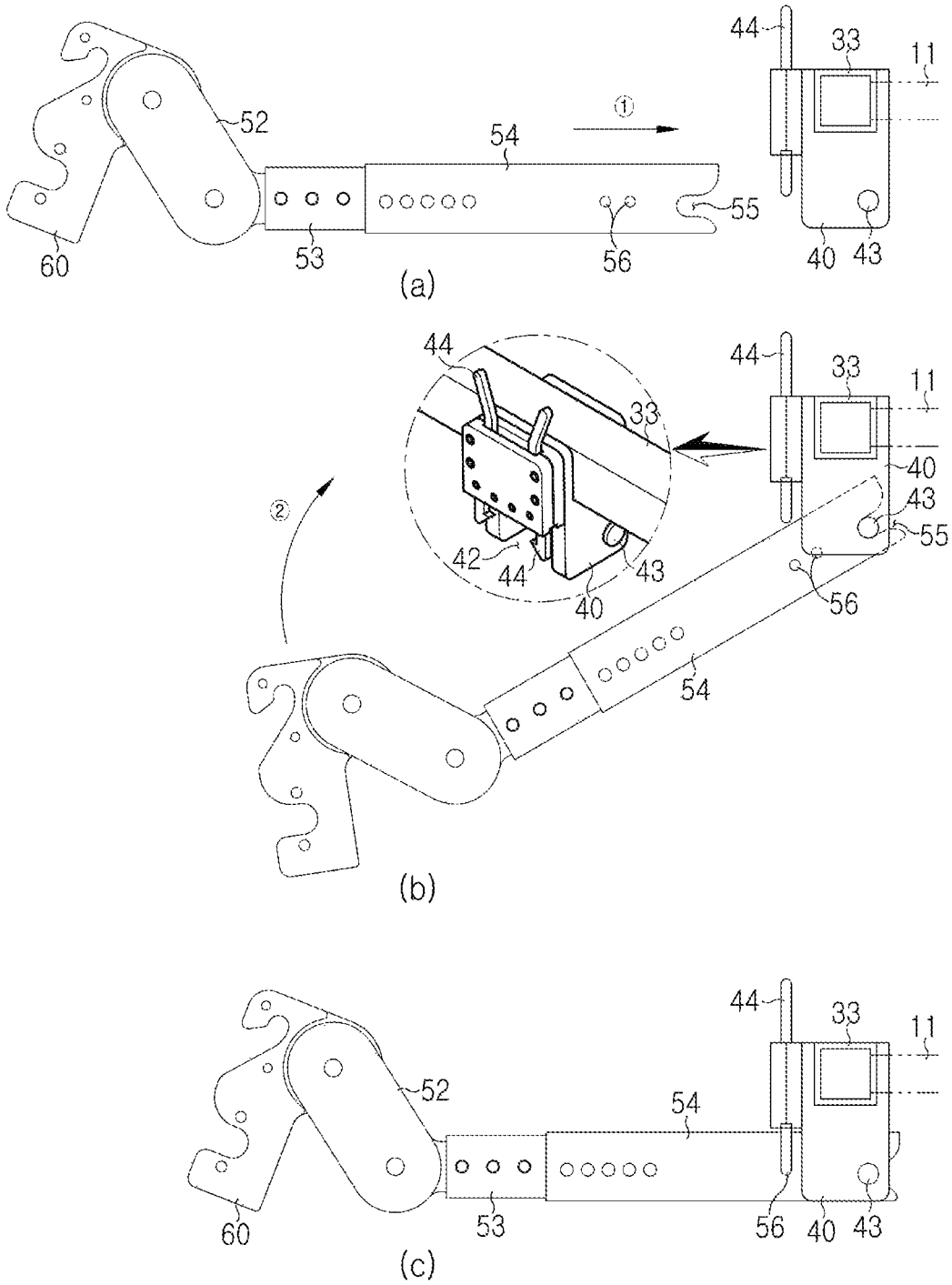

【Figure 7】
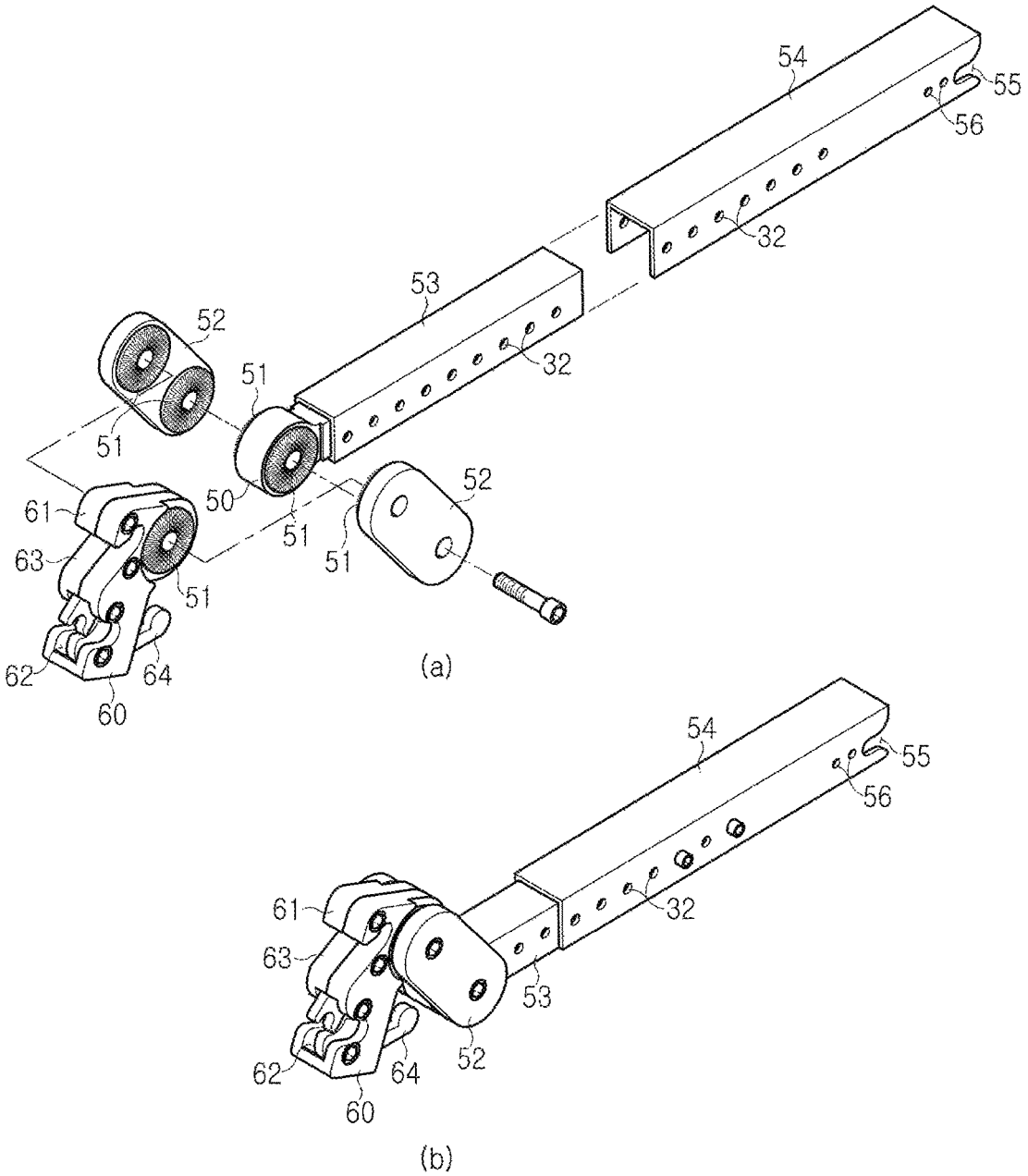

【Figure 8】
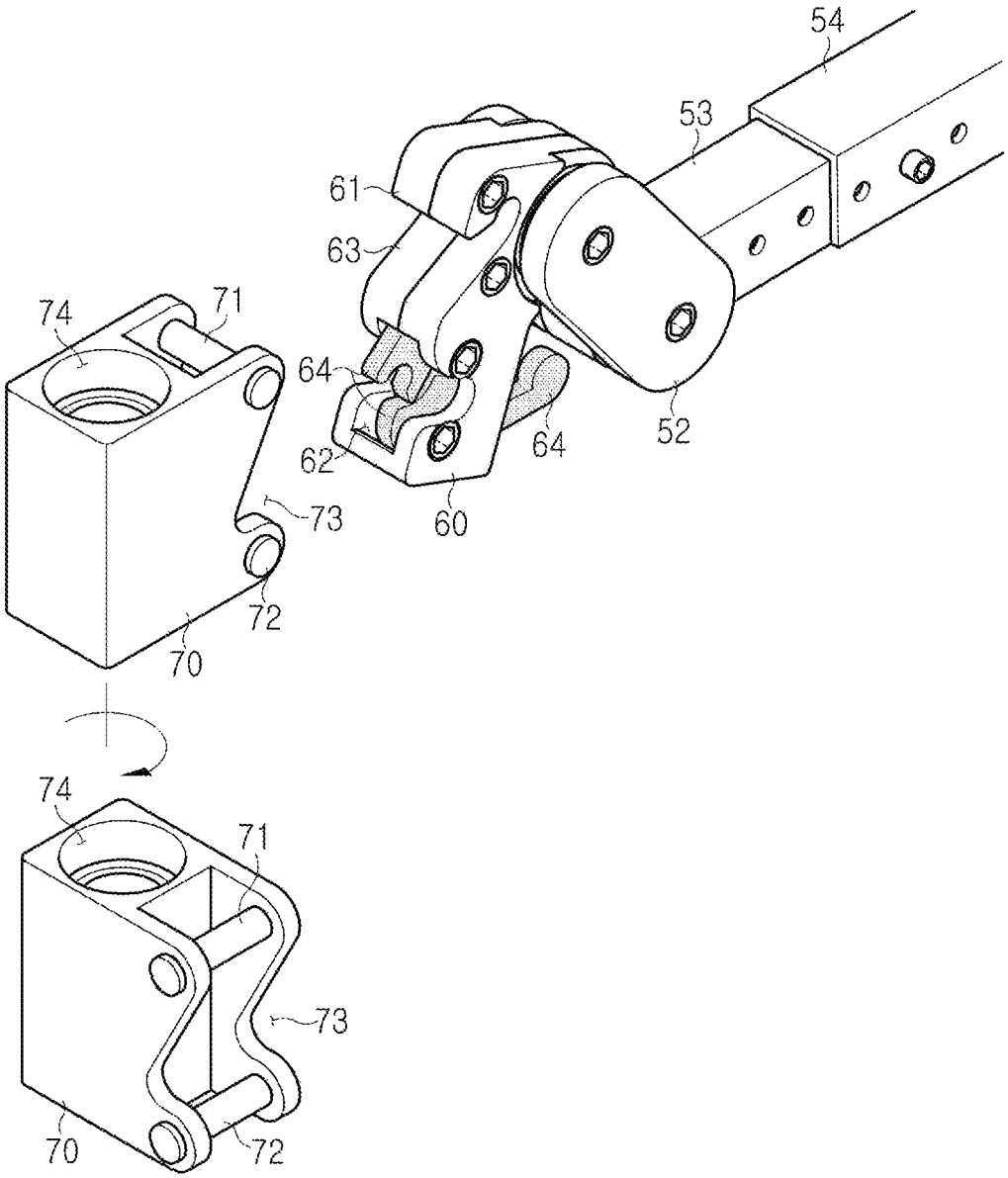

【Figure 9】
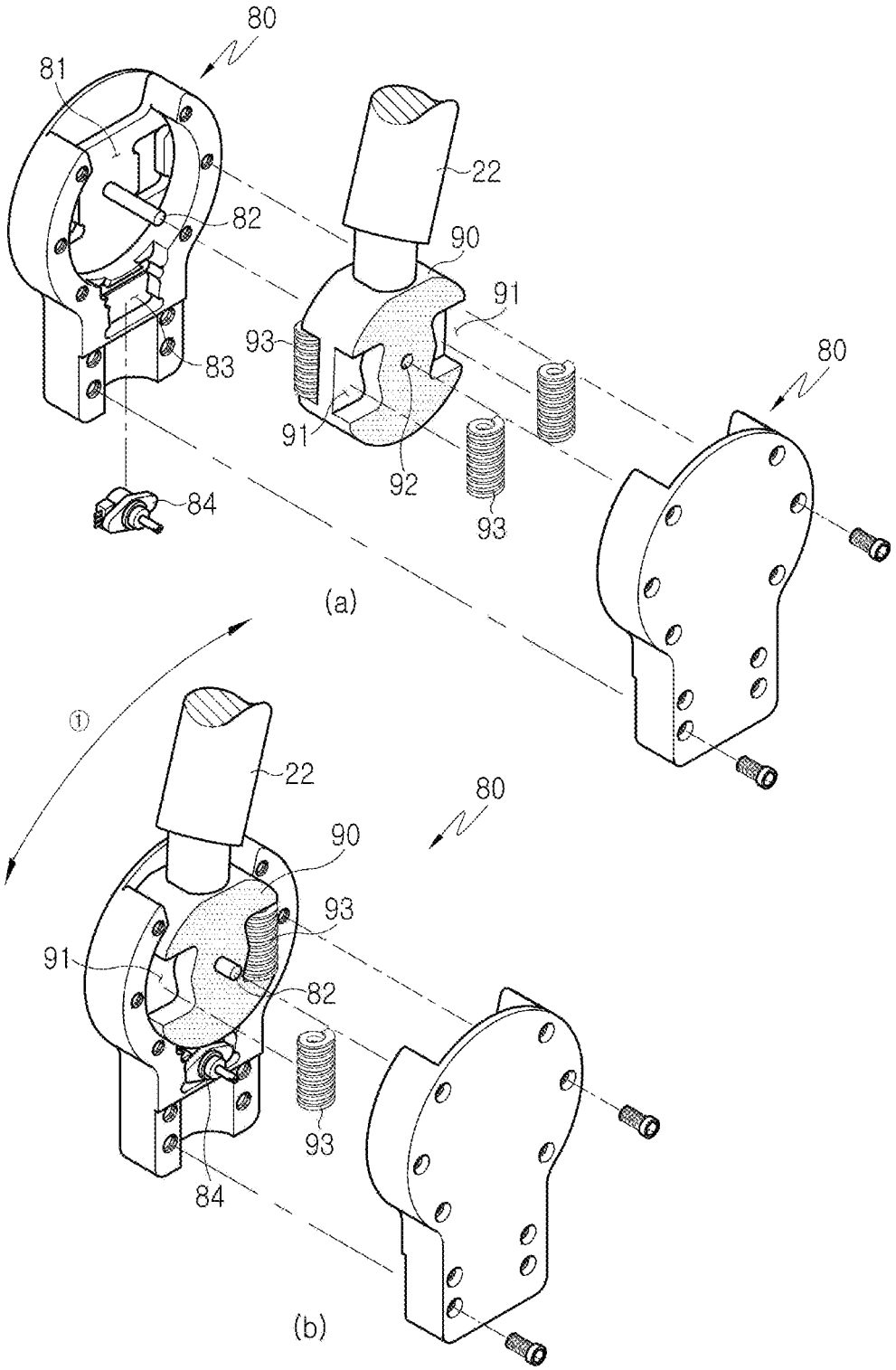

【Figure 10】
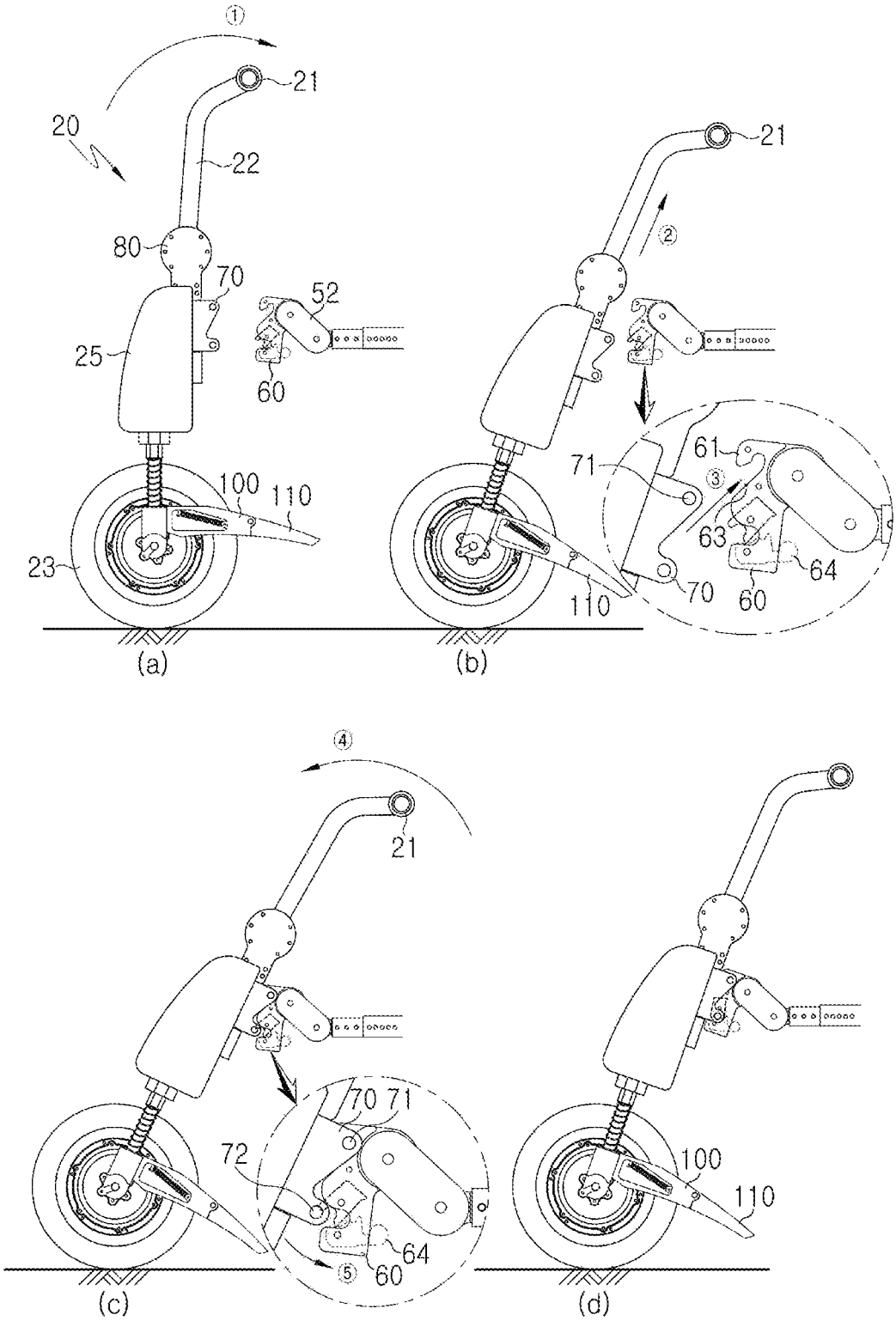

【Figure 11】
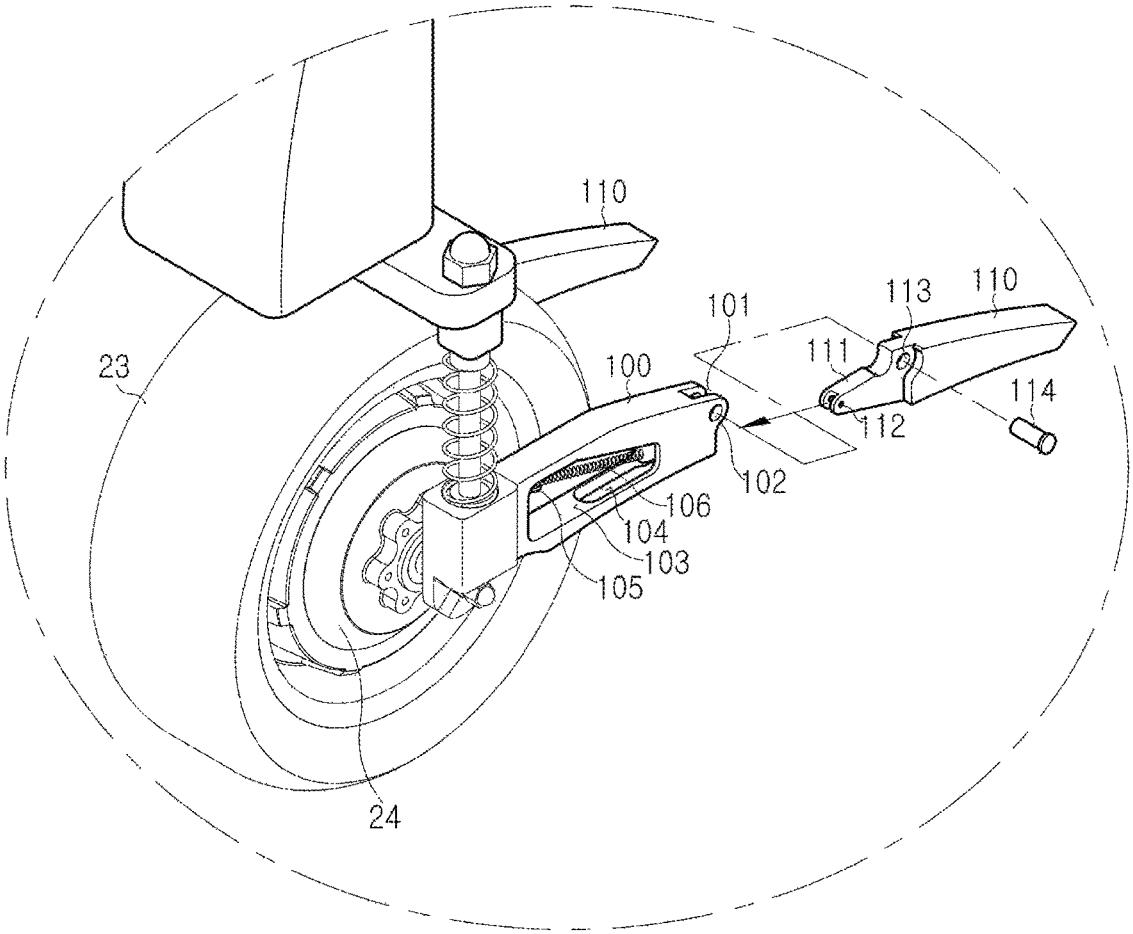

【Figure 12】
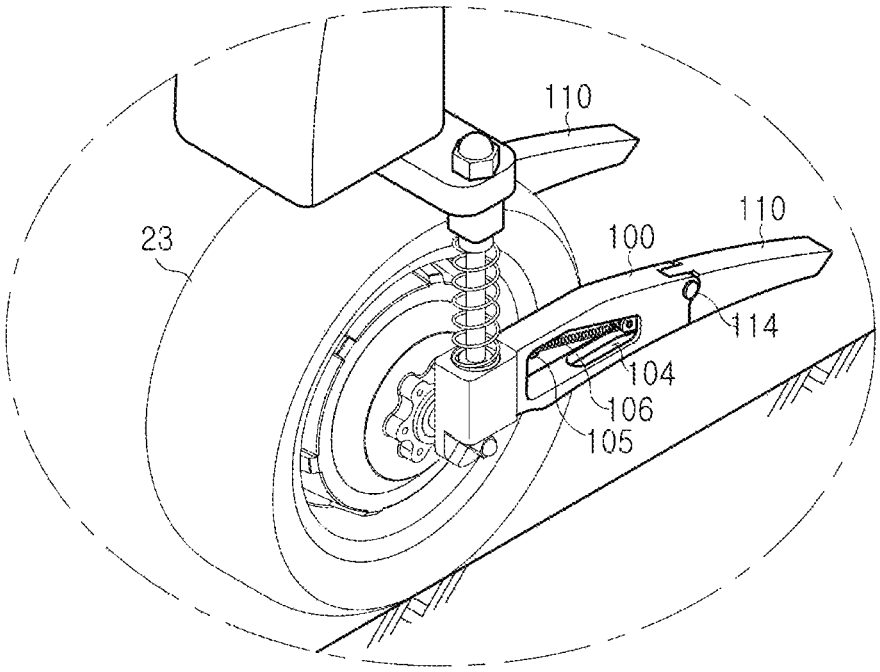
(a)
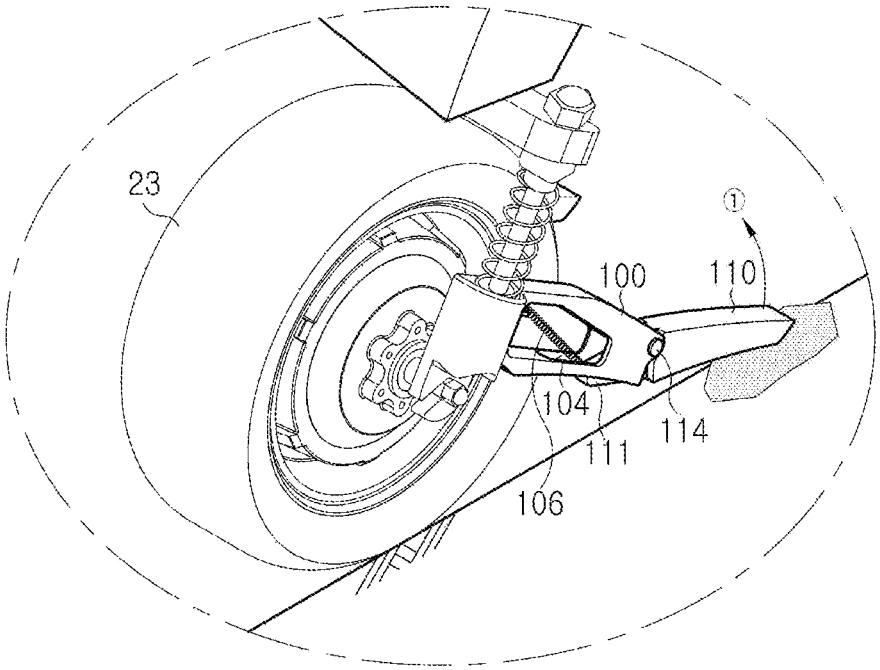
(b)

【Figure 13】
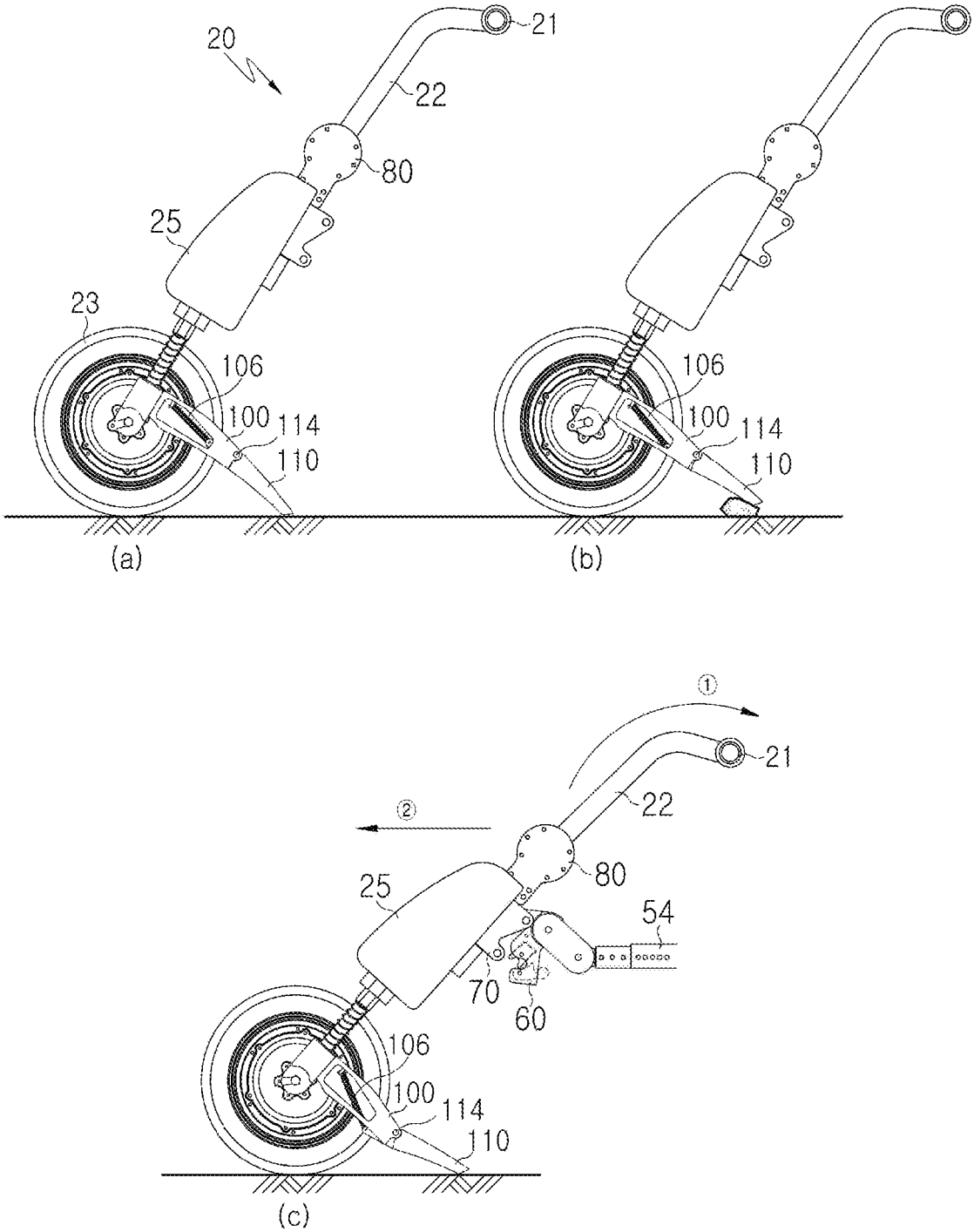

【Figure 14】
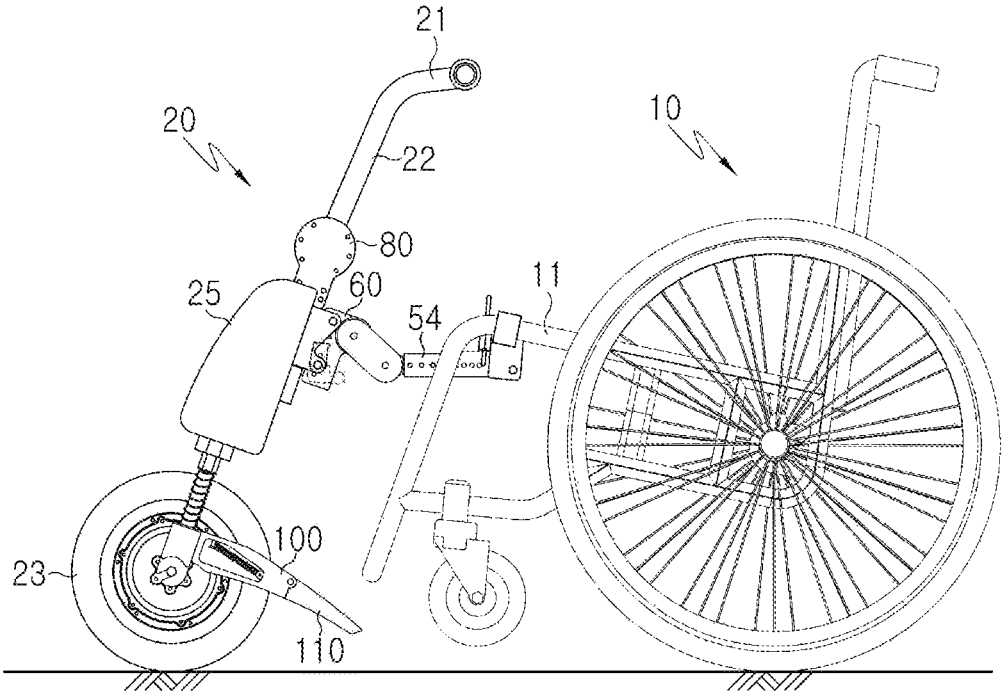

WHEELCHAIR POWER APPARATUS FOR ELECTRONIC DRIVING CONVERSION

BACKGROUND OF THE INVENTION

Field of the Invention

The present invention relates to a wheelchair power apparatus for electronic driving conversion, and more particularly, to a wheelchair power apparatus for electronic driving conversion, which can convert a manual wheelchair into an electronic wheelchair of a three-wheel type since having an electronic module detachably mounted on the manual wheelchair, which drives when a disabled person, an old person or a weak person rolls wheels with hands.

Background Art

FIG. 1 is a perspective view of a general wheelchair. The wheelchair 10 illustrated in FIG. 1 is a manual wheelchair 10, which is used as a transportation means for the disabled or the old. The wheelchair includes large wheels mounted at both sides of a seat for driving and small wheels mounted sides of foot rests to be able to rotate a full 360 degrees for direction change, so is operated in a four-wheel drive type.

The manual wheelchair 10 illustrated in FIG. 1 can be loaded on a vehicle for a long distance movement since being lightweight and being capable of narrowing the width between the wheels based on the seat to reduce volume. However, considering that a rider who is disabled holds an actuation rim 12 mounted along the edge of the wheel and operates the wheel just with muscle strength sitting on the seat, the manual wheelchair 10 is limited as an assistant transportation means for short-distance driving.

SUMMARY OF THE INVENTION

Accordingly, the present invention has been made to solve the above-mentioned problems occurring in the prior arts, and it is an object of the present invention to provide a wheelchair power apparatus for electronic driving conversion, which can provide severely disabled people, for instance, patients with spinal cord injury, the weak or the old, who use wheelchairs, with convenience in movement, and convert a manual four-wheel wheelchair into an electronic three-wheel wheelchair just by detachably mounting the electronic module having electronic wheels to the existing manual four-wheel wheelchair.

It is another object of the present invention to provide a wheelchair power apparatus for electronic driving conversion, which includes strut supports and collapsible bar mounted at right and left sides of a driving wheel, thereby easily standing the electronic module separated from the wheelchair, easily passing external force, such as rubble stones, due to the rotating collapsible bars colliding during driving, and allowing a user to easily remove the electronic module since the collapsible bars rotate even though the collapsible bars touch the ground and cause interference during separation of the electronic module.

To accomplish the above object, according to the present invention, there is provided a wheelchair power apparatus for electronic driving conversion including: an electronic module combined with a combining means of a manual wheelchair, wherein the electronic module includes: a driving wheel in which an in-wheel motor is mounted; an operation handle located directly above the driving wheel; a connector connected directly below the operation handle; a steering housing mounted directly below the connector in such a way that one side of the connector can be moved forwards or backwards inside the steering housing; a combining unit mounted directly below the steering housing and combined with a coupling means of a wheelchair; a battery mounted at the front of the combining unit; and strut supports and collapsible bars mounted at right and left sides of the driving wheel, so that the manual wheelchair is converted into an electronic wheelchair.

Moreover, the strut support of which one side is mounted on the side of the driving wheel includes: an insertion hole formed in the other side of the strut support, wherein an insertion member of the collapsible bar is inserted into the insertion hole; a first joining hole formed at an entrance portion of the insertion hole; a hollow portion formed at the center of the strut support; a first holding member formed at an upper portion of one side of the hollow portion for fixing one end of an elastic member; and a drawing hole formed below the hollow portion. The collapsible bar includes: an insertion member formed at one side of the collapsible bar; a second holding member formed at the front end of the insertion member to fix the other end of the elastic member; a second joining hole formed at an upper portion of the other side of the insertion member; and a rotational pin passing through the first joining hole of the strut support and the second joining hole of the collapsible bar so that the collapsible bar is upwardly rotated on the rotational pin by external force.

According to the present invention, the driving method of the wheelchair power apparatus for electronic driving conversion can provide the disabled, the weak or the old with convenience in movement by simply converting the existing manual wheelchair into the electronic wheelchair.

Furthermore, the wheelchair power apparatus for electronic driving conversion can reduce burden of expenses because there is no need to buy a high-priced electronic wheelchair, and can provide convenience in movement at a place to visit or at a vacation spot since a general electronic wheelchair cannot be loaded in a trunk of a vehicle but the wheelchair according to the present invention can be loaded in a trunk of a vehicle after the electronic module is separated from the manual wheelchair and the wheelchair is folded.

In the meantime, the wheelchair power apparatus for electronic driving conversion, which includes strut supports and collapsible bars mounted at right and left sides of a driving wheel, thereby easily standing the electronic module separated from the wheelchair, easily passing external force, such as rubble stones, due to the rotating collapsible bars colliding during driving, and allowing a user to easily remove the electronic module since the collapsible bars rotate even though the collapsible bars touch the ground and cause interference during separation of the electronic module.

BRIEF DESCRIPTION OF THE DRAWINGS

The above and other objects, features and advantages of the present invention will be apparent from the following detailed description of the preferred embodiments of the invention in conjunction with the accompanying drawings, in which:

FIG. 1 is a perspective view of a general wheelchair;

FIG. 2 is a perspective view of a wheelchair on which an electronic module according to the present invention is mounted;

FIG. 3 is a perspective view of the electronic module according to the present invention;

FIG. 4 is an exploded perspective view of the electronic module according to the present invention;

FIG. 5 is a perspective view showing a clamp, a horizontal support, and a coupling hub according to the present invention;

FIG. 6 is a side view showing the order for explaining assembly of the horizontal support and a vertical support according to the present invention;

FIG. 7 is a perspective view showing an angle setting hub, the vertical support and a combining hub according to the present invention;

FIG. 8 is a perspective view showing a coupling unit according to the present invention;

FIG. 9 is an exploded perspective view showing a steering housing and a steering unit according to the present invention;

FIG. 10 is a side view showing an assembly order of an electronic module according to the present invention;

FIG. 11 is an exploded perspective view showing strut supports and collapsible bars according to the present invention;

FIG. 12 is a perspective view showing a used state of the strut supports and the collapsible bars;

FIG. 13 is a side view showing the used state of the strut supports and the collapsible bars; and FIG. 14 is a side view showing a combined state of the electronic module according to the present invention.

DETAILED DESCRIPTION OF THE PREFERRED EMBODIMENT

Hereinafter, reference will be now made in detail to the preferred embodiment of the present invention with reference to the attached drawings. In the description of the present invention, when it is judged that detailed descriptions of known functions or structures and systems related with the present invention may make the essential points vague, the detailed descriptions of the known functions or structures will be omitted.

FIG. 2 is a perspective view of a wheelchair on which an electronic module according to the present invention is mounted, FIG. 3 is a perspective view of the electronic module according to the present invention, and FIG. 4 is an exploded perspective view of the electronic module according to the present invention.

As shown in FIGS. 2 to 4, a manual wheelchair 10 includes an electronic module 20 located at the front of the manual wheelchair 10. The electronic module 20 is connected with a seat frame 11 of the wheelchair 10, and is detachably and conveniently combined through components, such as a clamp 30, a coupling hub 40, a horizontal support 33, a combining hub 60, and a vertical support 54, in a one-touch way.

The electronic module 20 includes: a driving wheel 23 in which an in-wheel motor 24 is mounted; an operation handle 21 mounted directly above the driving wheel 23 for allowing the rider to grip with the fingers or to put the palm or the wrist; and a connector 22 connected directly below the operation handle so that the connector 22 can move in a forward or backward direction inside a steering housing 80 by an action of an elastic body, such as a spring.

Moreover, a combining unit 70 is mounted directly below the steering housing 80. A removable battery 25 is mounted at the front of the combining unit 70, and is combined with the combining hub 60, which is one of combining means of the wheelchair 10, through the combining unit 70 in a one-touch way so that the electronic module 30 is easily mounted on the wheelchair 10.

Moreover, strut supports 100 and collapsible bars 110 are mounted at right and left of the driving wheel 23 to allow a user to easily stand the electronic module 20 separated from the wheelchair 10.

In the meantime, the collapsible bar 110 is rotatably mounted on the strut support 100 so as to return to its original position by an elastic member 106, such as a spring, so rotates upwards not to cause interference even though the collapsible bar 110 touches the ground while the electronic module 20 is separated from the wheelchair 10.

Furthermore, as shown in FIG. 3, a controller 26 is mounted at a portion of the electronic module 20. The controller 26 controls various processors related with driving direction, driving speed and braking of the electronic module 20.

FIG. 5 is a perspective view showing a clamp 30, the horizontal support 33, and a coupling hub 40 according to the present invention. As shown in FIG. 5(A), the clamp 30 is disposed on the seat frame 11 of the wheelchair 10. The clamp 30 is formed in a round shape at the center thereof in consideration that the seat frame 11 is generally formed in an annular shape, and is formed in a split shape to be mounted universally regardless of the size of the outer diameter of the seat frame 11.

As shown in FIG. 2, when the clamps 30 are mounted at both sides of the seat frame 11, the horizontal support 33 for connecting two clamps 30 is connected in a crosswise direction in a state that a rider sits thereon. Because wheelchairs 10 may be different in interval of the seat frame 11, a plurality of interval adjusting holes 32 are formed at both sides of the horizontal support 33, and a clamp adjuster 31 having a plurality of adjusting holes 32 is formed at one side of the clamp 30 to adjust the interval while being inserted into the horizontal support 33.

Furthermore, the coupling hub 40 is mounted directly below the center of the horizontal support 33. The coupling hub 40 includes: a seating groove 41 formed at an upper portion to allow the horizontal support 33 to be seated; an insertion groove 42 formed at a lower portion so that the vertical support 54 is fit thereinto; a support pin 43 located inside the insertion groove 42; and a clip type lock 44 mounted at the front.

Therefore, as shown in FIG. 5(B), when the vertical support 54 is fit into the insertion groove 42 of the coupling hub 40, the vertical support 54 is firmly mounted on the horizontal support 33 by the clip type lock 44 in a one-touch way.

Referring to FIG. 6, assembly of the horizontal support 33 and the vertical support 54 will be described. FIG. 6 is a side view showing the order for explaining assembly of the horizontal support and the vertical support according to the present invention. FIG. 6 illustrates the side of the seat frame 11 that the horizontal support 33 and the coupling hub 40 are mounted on the seat frame 11.

As shown in FIG. 6(A), the rider moves the vertical support 54 in the direction of arrow number ① toward the insertion groove 42 of the coupling hub 40 in a downwardly inclined state, so a support groove 55 of the vertical support 54 is combined with the support pin 43 of the coupling hub 40 as shown in FIG. 6(B).

In the above state, as shown in FIG. 6(B), when the rider rotates the vertical support 54 in the direction of arrow number ②, the vertical support 54 rotates stably based on the support pin 43 of the coupling hub 40, and finally, as shown in the perspective view of FIG. 6(B), a coupling hole 56 of the vertical support 54 is naturally coupled to the clip type lock 44. Therefore, the vertical support 54 and the horizontal support 33 are combined vertically as shown in FIG. 6(C).

FIG. 7 is a perspective view showing an angle setting hub 50, the vertical support 54 and a combining hub 60 according to the present invention, and FIG. 8 is a perspective view showing the combining unit 70 according to the present invention. As described above, the vertical support 54 is disposed to be combined to the horizontal support 33. As shown in FIG. 7(A), the support groove 55 is formed at one end of the vertical support 54, coupling holes 56 coupled with the clip type lock 44 are formed at both sides spaced apart from the support groove 55 at a predetermined interval, and the plurality of interval adjusting holes 32 are formed at both sides of the vertical support 54.

Moreover, as shown in FIG. 7(A), the angle setting hub 50 having radial saw-toothed parts 51 formed at both sides is disposed, an angle adjuster 53 is formed at one side of the angle setting hub 50, and a plurality of length adjusting holes 32 are formed at both sides of the angle adjuster 53. Therefore, a distance between the electronic module 20 and the rider can be adjusted according to the rider's physical conditions while the angle adjuster 53 is fit into the vertical support 54.

Furthermore, as shown in FIG. 7(A), the combining hub 60 directly combined with the electronic module 20 is disposed, and the radial saw-toothed parts 51 are formed at both sides of the rear portion of the upper part of the combining hub 60, so that the combining hub 60 and the angle setting hub 50 are combined with each other through a long angle setting bar 52 having the radial saw-toothed parts 51 formed at upper and lower portions.

That is, as shown in FIG. 7(A), the radial saw-toothed parts 51 formed at the lower portion of the angle setting bar 52 are combined with the radial saw-toothed parts 51 formed on the angle setting hub 50, and the radial saw-toothed parts 51 formed on the upper portion of the angle setting bar 52 are combined with the radial saw-toothed parts 51 formed on the combining hub 60. Therefore, when the assembly is completed as shown in FIG. 7(B), the most convenient driving posture suitable for the rider's physical conditions can be set accurately according to an angle adjusting method.

Meanwhile, as shown in FIG. 8, the combining unit 70 combined with the combining hub 60 is mounted on the electronic module 20 as shown in FIGS. 3 and 4, and is a means for mounting the electronic module 20 to the combining hub 60.

First, the combining hub 60 will be described in more detail. As shown in FIGS. 7 and 8, the radial saw-toothed parts 51 are formed at both sides of the rear portion of the upper part of the combining hub 60, a hook part 61 is formed at the front of the upper part of the combining hub 60, an inclined surface 63 is formed downwardly from the hook part 61, and a combining portion 62 is formed directly below the inclined surface 63. A snatch lock 64 is mounted inside the combining portion 62 as a combining means, so that a combining pin 72 of the combining unit 70 is caught to the snatch lock 64 in the one-touch way.

As shown in FIG. 8, the combining unit 70 includes a holding pin 71 mounted at the front of the upper part to be combined with the hook part 61 of the combining hub 60; the combining pin 72 mounted directly blow the holding pin 71 to be combined with the snatch lock 64 at the combining portion 62 of the combining hub 60 in the one-touch ways; an inclination corresponding groove 73 formed between the holding pin 71 and the combining pin 72 to correspond to the inclined surface 63 of the combining hub 60; and a fitting hole 74 formed at the rear of the combining unit 70 to be mounted to a shaft of the electronic module 20.

FIG. 9 is an exploded perspective view showing a steering housing 80 and a steering unit 90 according to the present invention. As shown in FIG. 9(A), the steering housing is made in a split type for easy assembly and can be integrated through a bolt.

A first mounting recess 81 in which the steering unit 90 is located is formed at the central portion inside the steering housing 80, and a rotary shaft 82 protrudes at the center of the first mounting recess 81 and fit into a fitting hole 92 formed at the center of the steering unit 90 so as to be rotated smoothly within a predetermined angle in forward and backward directions in a state that the steering unit 90 is mounted inside the steering housing 80.

Elastic body seating recesses 91 are formed at right and left sides of the steering unit 90 to be symmetrical to the front and the back based on the fitting hole 92. The elastic body seating recess 91 is a space where an elastic body, such as a coil spring 93, is mounted. In the present invention, the elastic body is a coil spring 93, but shapes and kinds of the elastic body is not limited.

The connector 22 of the operation handle 21 is mounted on the steering unit 90. When the rider moves the operation handle 21 forwards or backwards, as illustrated in FIG. 4, the steering unit 90 moves forwards or backwards at a predetermined angle inside the steering housing 80 as the rider set the steering direction.

As described above, the driving direction and speed of the electronic module 20 are maintained depending on movement of the steering unit 90 operated by the rider's power. When the power of the rider who pushes or pulls the steering unit 90 is removed, the steering unit 90 is restored into an initial state, namely, into a neutral condition by restoring force of the coil spring 93, and the electronic module 80 is in a braking state.

In the meantime, as shown in FIG. 9(A), a second mounting recess 83 in which an encoder 84 is mounted is formed directly below the first mounting recess 81 of the steering housing 80. The encoder 84 is located directly below the steering unit 90 as shown in FIG. 9(B) after being assembled. Therefore, when the steering unit 90 is rotated forwards or backwards, because the encoder 84 which controls the number of turns of the driving wheel 33 is operated, a driving speed is reduced if an angle of rotation of the steering unit 90 is small, and the wheelchair is stopped when the steering unit 90 is in a neutral condition that the angle of rotation is zero.

Furthermore, as shown in FIG. 3, a controller 26 is mounted at a portion of the electronic module 20. The controller 26 controls operation of the encoder 84 and various electrical processes related with driving directions, driving speed, and braking of the electronic module 20.

Detailed technical contents related with operations of the encoder 84 and the controller 26 have been well known, so the detailed description of the encoder and the controller will be omitted.

Referring to FIG. 10, the order that the electronic module 20 is mounted on the combining hub 60 will be described. FIG. 10 is a side view showing the assembly order of the electronic module 20 according to the present invention, as shown in FIG. 10(A), the rider who sits on a seat holds the operation handle 21 of the electronic module 20 and rotates the operation handle 21 in the direction of the arrow number ① so as to inclinedly locate the electronic module 20.

After that, as shown in FIG. 10(B), when the rider pulls the inclined electronic module 20 toward the rider's chest in the direction of the arrow number ②, as you can see from the enlarged view of FIG. 10(B), the holding pin 71 of the combining unit 70 moves along the inclined surface 63 of the combining hub 60 in the direction of the arrow number ③, and is caught to the hook part 61.

After that, as shown in FIG. 10(C), in a state that the holding pin 71 of the combining unit 70 and the hook part 61 of the combining hub 60 are assembled together, when the rider pushes the electronic module 20 in the direction of the arrow number ④ to rotate, the electronic module 20 rotates stably around the holding pin 71 of the combining unit 70, and the combining pin 72 of the combining unit 70 rotates toward the snatch lock 64 mounted in the combining portion 62 of the combining hub 60 in the direction of the arrow number ⑤ in the one-touch way as shown in the enlarged view of FIG. 10(C), so that the electronic module 20 can be conveniently mounted on the combining hub 60 as shown in FIG. 10(D).

FIG. 11 is an exploded perspective view showing a strut support 100 and a collapsible bar 110 according to the present invention, and FIG. 12 is a perspective view showing a used state of the strut support 100 and the collapsible bar 110. As shown in FIG. 11, the strut support 100 and the collapsible bar 110 are assembled and mounted at right and left sides of the driving wheel 23.

That is, one side of the strut support 100 is mounted at the side of the driving wheel 23, and includes: an insertion hole 101 formed at the other side of the strut support 100 so that an insertion member 111 of the collapsible bar 110 is inserted into the insertion hole 101; a first joining hole 102 formed at an entrance portion of the insertion hole 101; and a hollow portion 103 formed at the center of the strut support 100 so that an elastic member 106 and the insertion member 111 of the collapsible bar 110 are located.

A first holding member 105 for fixing one end of the elastic member 106, such as a coil spring, is formed at an upper portion of one side of the hollow portion 103, and a drawing hole 104 is formed below the hollow portion 103. The drawing hole 104 communicates with the insertion hole 101, and is a space where the insertion member 111 of the collapsible bar 110 goes in and out by restoring force of the elastic member 106.

In the meantime, the collapsible bar 110 touches the ground when the electronic module 20 stands up. The collapsible bar 110 includes: an insertion member 111 formed at one side of the collapsible bar 110; a second holding member 112 formed at the front end of the insertion member 111 to fix the other end of the elastic member 106; and a second joining hole 113 formed at an upper portion of the other side of the insertion member 111 to be assembled with the first joining hole 102 of the strut support 100. Therefore, while a rotational pin 114 passes through the first joining hole 102 of the strut support 100 and the second joining hole 113 of the collapsible bar 110, as shown in FIG. 12(A), the strut support 100 and the collapsible bar 110 are firmly assembled together.

FIG. 12(A) illustrates that an initial state is maintained by tensile force of the elastic member 106 in the state that the collapsible bar 110 is assembled to the strut support 100, and FIGS. 12(B) and 13(B) illustrate that the electronic module 20 drives smooth even on an irregular road surface while rotating on the rotational pin 114 upwards in the direction of the arrow number ① as large as the size of rubble stones when the collapsible bar 110 mounted for an erect state of the electronic module 20 collides against external force, such as rubble stones, in case that the electronic module 20 drives on the uneven road.

FIG. 13 is a side view showing a used state of the strut support 100 and the collapsible bar 110. In FIG. 13(A), in the state that the electronic module 20 separated from the wheelchair 10 easily stands up using the strut support 100 and the collapsible bar 110, the strut support 100 and the collapsible bar 110 maintain the initial assembled state by tensile force of the elastic member 106.

In the meantime, FIG. 13(C) illustrates the operation of the collapsible bar 110 when the electronic module 20 is separated from the wheelchair 10. The rider pulls the operation handle 21 in the direction of the arrow number ① in order to separate the electronic module 20 from the wheelchair, and then, pushes in the direction of the arrow number ②. So, the combining unit 70 of the electronic module 20 is removed from the combining hub 60 of the wheelchair 10.

In the above process, a mounting angle of the electronic module 20 gets smaller based on the ground to be an acute angle, and finally, the collapsible bar 110 touches the ground surface. In this instance, if the collapsible bar 110 touching the ground does not rotate, due to an interference, it is impossible that the disabled, the old or the weak separate the electronic module 20 from the wheelchair by themselves.

However, as shown in FIG. 13(C), if external force touching the ground surface is applied to the collapsible bar 110, the collapsible bar 110 elastically rotates on the rotational pin 114 of the strut support 100 upwards while overcoming tensile force of the elastic member 106. Therefore, the problem of interference against the ground generated when the electronic module 20 is separated from the wheelchair can be solved.

FIG. 14 is a side view showing combination of the electronic module 20 according to the present invention. As shown in FIG. 14, when the electronic module 20 having the strut support 100 and the collapsible bar 110 mounted at right and left sides of the driving wheel 23 is mounted on the manual wheelchair 10, the 360-degree rotatable small wheels assembled to the wheelchair 10 is lifted from the ground and is conveniently converted from the manual four-wheel type wheelchair 10 into the electronic three-wheel type wheelchair 10 to provide the disabled or the weak with convenience in movement.

Meanwhile, considering that the wheelchair having the electronic module is a detachable type, for long-distance movement, the manual wheelchair 10 is folded and loaded on a vehicle and the electronic module 30 and other coupling means are separated from the wheelchair and loaded on the vehicle. At a destination, the manual four-wheel wheelchair 10 is converted into the electronic three-wheel wheelchair 10, so the wheelchair according to the present invention provides vulnerable users with convenience in movement and enriches their lives.

Moreover, the present invention can provide the disabled, the weak or the old with convenience by simply converting the existing manual four-wheel wheelchair into the electronic three-wheel wheelchair.

In the meantime, the present invention can reduce burden of expenses because there is no need to buy a high-priced electronic wheelchair, and can provide convenience in movement at a place to visit or at a vacation spot since a general electronic wheelchair cannot be loaded in a trunk of a vehicle but the wheelchair according to the present invention can be loaded in a trunk of a vehicle after the electronic module 30 is separated from the manual wheelchair and the wheelchair is folded.

What is claimed is:

1. A wheelchair power apparatus for electronic driving conversion comprising:

an electronic module combined with a manual wheelchair, wherein the electronic module comprises of a driving wheel in which an in-wheel motor is mounted, an operation handle located directly above the driving wheel, a connector connected directly below the operation handle, a steering housing mounted directly below the connector in such a way that one side of the connector can be moved forwards or backwards inside the steering housing, a combining unit mounted directly below the steering housing and combined with a wheelchair, a battery mounted at the front of the combining unit, and strut supports and collapsible bars mounted at right and left sides of the driving wheel so that the manual wheelchair is converted into an electronic wheelchair, wherein at least one of the strut supports of which one side is mounted on the side of the driving wheel comprises an insertion hole formed in the other side of the at least one strut support, wherein an insertion member of at least one of the collapsible bars is inserted into the insertion hole; a first joining hole formed at an entrance portion of the insertion hole; a hollow portion formed at the center of the at least one strut support; a first holding member formed at an upper portion of one side of the hollow portion for fixing one end of an elastic member; and a drawing hole formed below the hollow portion, and wherein the at least one collapsible bar includes: an insertion member formed at one side of the at least one collapsible bar; a second holding member formed at the front end of the insertion member to fix the other end of the elastic member; a second joining hole formed at an upper portion of the other side of the insertion member; and a rotational pin passing through the first joining hole of the at least one strut support and the second joining hole of the at least one collapsible bar so that the at least one collapsible bar is upwardly rotated on the rotational pin by external force.

* * * * *